US007159515B2

(12) United States Patent
Koopmann et al.

(10) Patent No.: US 7,159,515 B2
(45) Date of Patent: Jan. 9, 2007

(54) DEVICE FOR ATTACHING A ROLLER TO AN ABUTMENT MOVING ESSENTIALLY AT THE PERIPHERAL SPEED OF THE ROLLER BY MEANS OF A SPINDLE-NUT COMBINATION

(75) Inventors: Dietmar Koopmann, Lienen (DE); Robert Blom, Tecklenburg (DE); Guenter Rogge, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/502,652

(22) PCT Filed: Mar. 10, 2003

(86) PCT No.: PCT/EP03/02451

§ 371 (c)(1),
(2), (4) Date: Aug. 3, 2004

(87) PCT Pub. No.: WO03/076189

PCT Pub. Date: Sep. 18, 2003

(65) Prior Publication Data

US 2005/0098053 A1 May 12, 2005

(30) Foreign Application Priority Data

Mar. 14, 2002 (DE) ..... 102 11 328

(51) Int. Cl.
*B41F 13/24* (2006.01)

(52) U.S. Cl. ..... 101/247; 101/182

(58) Field of Classification Search ..... 101/247, 101/182, 185, 209, 351.1, 352.01; 74/441
See application file for complete search history.

(56) References Cited

U.S. PATENT DOCUMENTS

| | | | | | |
|---|---|---|---|---|---|
| 1,707,442 | A | | 4/1929 | Maag | 74/441 |
| 2,195,799 | A | | 4/1940 | Parsons | 74/441 |
| 3,635,160 | A | * | 1/1972 | Specht et al. | 101/247 |
| 3,847,033 | A | * | 11/1974 | Toth | 74/424.87 |
| 4,022,076 | A | * | 5/1977 | Metz | 74/441 |
| 4,395,947 | A | * | 8/1983 | Despot | 101/352.02 |
| 4,413,541 | A | * | 11/1983 | Biggar, III | 83/346 |
| 4,527,474 | A | * | 7/1985 | Lubke et al. | 101/249 |
| 4,852,515 | A | * | 8/1989 | Terasaka et al. | 118/663 |
| 4,872,795 | A | * | 10/1989 | Davis | 74/441 |
| 5,125,339 | A | | 6/1992 | Rogge | 101/247 |
| 5,341,739 | A | * | 8/1994 | Rogge et al. | 101/247 |
| 6,041,671 | A | * | 3/2000 | Erikson et al. | 74/441 |
| 6,142,032 | A | | 11/2000 | Creager | 74/441 |

FOREIGN PATENT DOCUMENTS

| | | |
|---|---|---|
| DE | 846 647 | 8/1952 |
| DE | 37 10301 A1 | 1/1988 |
| DE | 40 01 735 A1 | 7/1991 |

* cited by examiner

*Primary Examiner*—Anthony H. Nguyen
(74) *Attorney, Agent, or Firm*—Jacobson Holman PLLC

(57) ABSTRACT

A spindle-nut combination for applying a roller to a counterbearing moved essentially at the circumferential speed of the roller. In order to be able to adjust the play of the spindle in a simple manner, an additional nut is associated with, and displaceable against the spindle nut. Both nuts mesh with the thread of the spindle. An additional securable nut is also provided to brace against the additional nut and prevent undesired turning thereof.

19 Claims, 2 Drawing Sheets

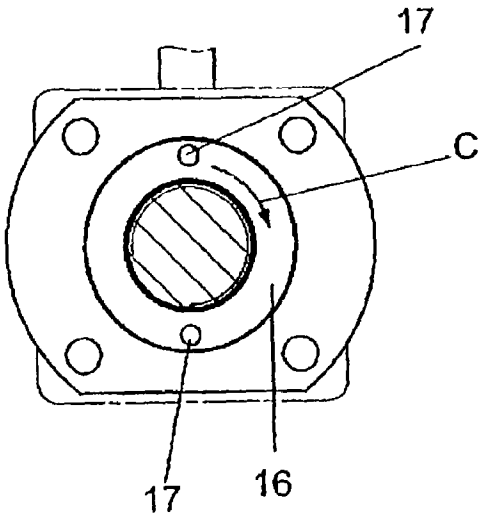
Figure3
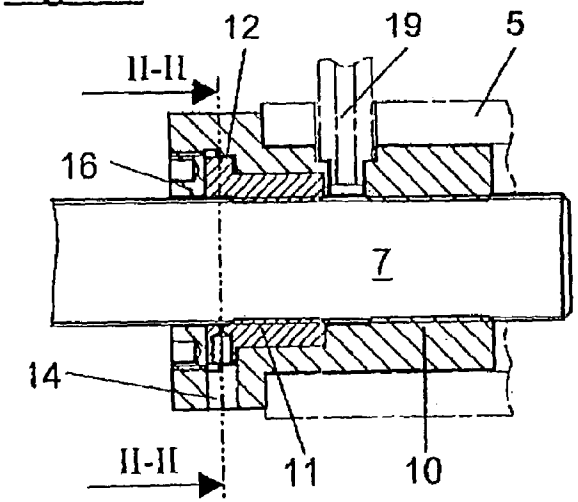
Figure2
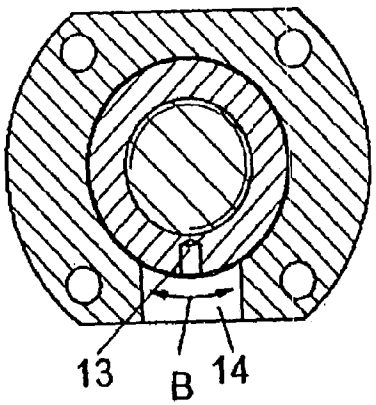
Figure4 II-II

DEVICE FOR ATTACHING A ROLLER TO AN ABUTMENT MOVING ESSENTIALLY AT THE PERIPHERAL SPEED OF THE ROLLER BY MEANS OF A SPINDLE-NUT COMBINATION

This is a nationalization of PCT/EP03/02451 filed Mar. 10, 2003 and published in German.

BACKGROUND OF THE INVENTION

1. Field of the Invention

The invention relates to a device for applying a roller, by means of a spindle-nut combination, to a counterbearing moved essentially at the circumferential speed of the roller, preferably for applying a print roller or anilox roller to the central impression cylinder of a flexographic printing press.

2. Description of the Related Art

A spindle screwed into the spindle nut customarily has, between the threads, a certain play, which, over time, can increase in an undesired manner. For example, in the case of flexographic printing presses (DE 29 41 521 A1, DE 34 37 216 C2, DE 37 42 129 A1, DE 40 01 735 A1), the bearing blocks, which can be traversed in the guides of brackets of the printing press frame, are moved by spindle drives to apply the print roller to, and to withdraw it from, the impression roller. Since the print rollers have to be applied very delicately to the print substrate running over the impression roller, increasing play of the spindles can have a disadvantageous effect on the quality of the printing.

SUMMARY OF THE INVENTION

It is thus the objective of the invention to provide a device of the type specified initially whose play can be adjusted so that it is possible to avoid exchanging the spindle or spindle nut when play increases.

According to the present invention this objective is realized by a device for applying a roller, by means of a spindle-nut combination, to a counterbearing moved essentially at the circumferential speed of the roller, preferably for applying a print roller or anilox roller to the central impression cylinder of a flexographic printing press. An additional nut is associated with, and displaceable against, the spindle nut, where both nuts mesh with the thread of the spindle and the additional nut can be secured.

Advantageous developments of the invention include the additional nut being formed as an adjusting ring which is associated with a securing ring. The securing ring can have an outer thread which conforms to the inner thread of a holder which is immovable with respect to the spindle nut. The holder can be a Part of the spindle nut.

According to a preferred form of embodiment, that the spindle nut is provided with a hole section with an inner thread, the diameter of said hole section being expanded, into which thread an adjusting ring is screwed by its outer thread. The adjusting ring has an inner thread which conforms to a part of the thread of the spindle, and also has an apparatus for turning and a turning constraint for its fixation. The spindle according to the invention is distinguished by the fact that the thread of the spindle nut consists of two sections which are displaceable in the axial direction relative to one another so that thereby a desired play can be reduced in the intended manner. Due to the fact that according to the invention the play of the spindle in the spindle nut can be reduced, the lifetime of the spindle can be increased significantly.

In an expedient manner the apparatus for turning consists of a radial hole of the adjusting ring. Into this hole, which can be a blind hole, a pin can be inserted and, via this, the adjusting ring can be turned by a suitable angle for the reduction of the play. In order to make this radial hole accessible in a simple manner, it can be reachable through a slot, running in the circumferential direction, in the spindle nut.

After the adjustment of the adjusting ring, it is to be secured in its position. As a constraint against unintended turning, a securing ring provided with an outer thread can be provided, where said securing ring can be screwed into the spindle nut and braced against the adjusting ring. In order to also be able to turn the securing ring to brace it against the adjusting ring, it can be provided with two axially directed holes.

In an expedient manner the spindle nut is provided with a radial hole for the supply of lubricant. This not only reduces the wear but also serves to reduce the play. In an expedient manner the lubricant hole empties at the boundary of the expanded hole section of the spindle nut.

BRIEF DESCRIPTION OF THE DRAWINGS

An embodiment example of the invention will be explained in more detail in the following with the aid of the drawings.

FIG. 2 is a longitudinal section through an encircled part in FIG. 1, said part showing a spindle nut with spindle screwed in.

FIG. 3 is a frontal view of the spindle nut.

FIG. 4 a section through the spindle nut along the line II—II in FIG. 2.

DETAILED DESCRIPTION OF THE PREFERRED EMBODIMENTS

Figure 1:
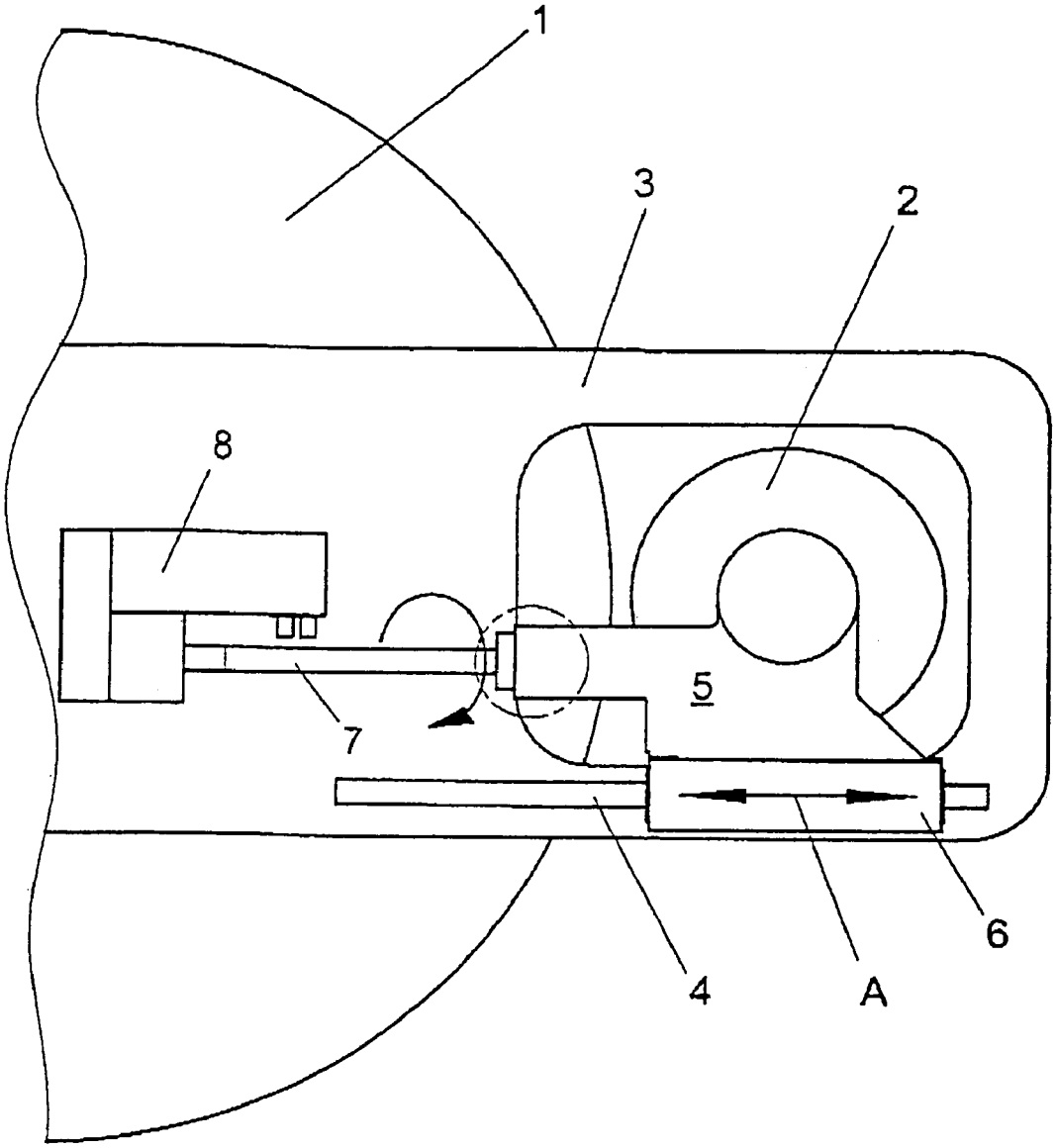
FIG. 1 is a lateral view, in schematic representation, of a flexographic printing press's print roller which can be applied to the impression roller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

From FIG. 1 a central impression cylinder 1 can be seen which is mounted in the customary manner in a printing pressing frame not represented. The printing pressing frame is provided with two laterally projecting side frames 3 of a printing device bracket which are each provided with guide rails 4 in which carriages 6, carrying bearing blocks 5, are guided in the direction of the double arrow A in such a manner that they can be displaced. In the bearing blocks 5 a print roller 2 is mounted in the customary manner. The drives of the central impression cylinder 1 and the print cylinder 2 are of the customary type and thus not represented.

In order to apply the print roller 2 to, and withdraw it from, the central compression cylinder 1, spindle drives are provided, where each spindle 7 can be driven by a drive motor 8 which is connected to the printing press frame or to each of the side frames 3. In the embodiment example represented, the spindle 7 is driven by the drive motor 8, but is axially immovable relative to it.

With the aid of FIGS. 2 to 4 the spindle nut, which is enclosed in FIG. 1 by a dotted circle, will be described in more detail.

In a hole of each of the bearing blocks 5, which is sufficiently deep or penetrating, a spindle nut 10 is inserted, in such a manner that it cannot be turned, and the spindle 7 is screwed into this spindle nut. The spindle nut 10 has on its left side in FIG. 2 an expanded hole section into which an adjusting ring 11 is screwed. This adjusting ring is provided with an inner thread which is formed basically in the same manner as the inner thread of the spindle nut 10. The adjusting ring 11 is provided with a widened edge section 12 which lies in an additional hole section of the spindle nut 10 that is widened via an annular step. This widened edge section 12 is provided with a blind hole 13 which lies in a slot 14 of the spindle nut 10, said slot running in the circumferential direction. Through the slot 14 a pin can be inserted into the blind hole 13 by which pin the adjusting ring 11 can be turned in the direction of the double arrow B in FIG. 4. Through appropriate turning, the adjusting ring 11 is turned, via its outer thread, in the inner thread of the expanded hole section so that it experiences a slight axial movement.

Into the inner thread of a holder which is immovable with respect to the spindle nut, a securing ring 16 is screwed. As shown in FIG. 4, the holder may be part of the spindle nut such that the securing ring 16 is screwed into the inner thread of the outer hole section, once again expanded via an annular step, of the spindle nut 10. The securing ring 16 is provided on its frontal side with two blind holes 17 lying opposite one another. Into these blind holes 17 the spikes of a suitable tool can be inserted so that the securing ring 16 can be turned in the direction of the arrow C and braced against the adjusting ring 11 to secure against its undesired turning.

The bearing block 5, as well as the spindle nut 10, is provided with a radial hole into which a line 19 for the supply of lubricant empties.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for applying a roller, by means of a spindle-nut combination, to a counterbearing moved essentially at the circumferential speed of the roller, comprising a spindle, a spindle nut and an additional nut in threaded engagement with said spindle, said additional nut fitting at least partly within, and being displaceable against, said spindle nut, and a securing ring having an outer thread in engagement with an inner thread of a holder which is immovable with respect to the spindle nut, said securing ring being configured by said threaded engagement in said holder to be screwed against the additional nut for axial bracing thereof to prevent unintended movement.

2. The device according to claim 1, wherein said additional nut is formed as an adjusting ring.

3. The device according to claim 1, wherein the holder is a part of the spindle nut.

4. The device according to claim 1, wherein said spindle nut includes a widened hole section having an inner diameter larger than an outer diameter of said spindle, said additional nut having an outer thread by which said additional nut is screwed into said inner thread of said widened hole section.

5. The device according to claim 4, wherein said additional nut is formed as an adjusting ring.

6. The device according to claim 5, wherein said holder is part of said spindle nut.

7. The device according to claim 6, wherein the securing ring has two axially directed blind holes on a frontal side thereof.

8. The device according to claim 1, wherein said additional nut includes a radial hole for turning said additional nut.

9. The device according to claim 8, wherein the radial hole is accessible through a circumferential slot in the spindle nut.

10. A spindle device for applying a print roller to, and withdrawing said print roller from, an impression roller of a printing press, comprising:

a spindle;

a spindle nut having a first section in threaded engagement with said spindle and having a widened hole section with an inner diameter larger than an inner diameter of said first section, said widened hole section having an inner thread;

an adjusting ring having an outer thread by which said adjusting ring is screwed into said inner thread of said widened hole section, said adjusting ring also having an inner thread by which said adjusting ring is engaged with a threaded part of said spindle; and a securing ring having an outer thread configured to be screwed into the widened hole section of said spindle nut and braced against the adjusting ring to prevent undesired movement thereof.

11. The device according to claim 10, wherein said adjusting ring includes an apparatus for turning said ring.

12. The device according to claim 11, wherein the apparatus for turning includes a radial hole in the adjusting ring.

13. The device according to claim 12, wherein the radial hole is accessible through a circumferential slot in the spindle nut.

14. The device according to claim 11, wherein said widened hole section of said spindle nut includes an annular step, and said adjusting ring includes a widened edge section that fits within said annular step, said apparatus for turning including a radial hole in said widened edge section.

15. The device according to claim 10, wherein the securing ring has two axially directed blind holes on a frontal side thereof.

16. The device according to claim 10, wherein said spindle nut is provided with a radial hole for supply of lubricant.

17. The device according to claim 16, wherein the lubricant hole empties at a boundary of the widened hole section of the spindle nut.

18. A spindle device for applying a print roller to, and withdrawing said print roller from, an impression roller of a printing press using a spindle, comprising:

a spindle nut having a first section in threaded engagement with said spindle and having a widened hole section with an inner diameter larger than an inner diameter of said first section, said widened hole section having an inner thread;

an adjusting ring having an outer thread by which said adjusting ring is screwed into said inner thread of said widened hole section, said adjusting ring also having an inner thread by which said adjusting ring is engaged with a threaded part of said spindle and a radial hole for turning said ring.

19. The device according to claim 18, wherein the radial hole is accessible through a circumferential slot in the spindle nut.

* * * * *